US008397794B2

(12) United States Patent
Nakayama et al.

(10) Patent No.: US 8,397,794 B2
(45) Date of Patent: Mar. 19, 2013

(54) TWIN ROLL CASTER AND METHOD OF CONTROL THEREOF

(75) Inventors: Katsumi Nakayama, Tokyo (JP); Atsushi Hirata, Tokyo (JP); Kiroyuki Otsuka, Tokyo (JP); Hisahiko Fukase, Tokyo (JP)

(73) Assignee: Castrip, LLC, Charlotte, NC (US)

( * ) Notice: Subject to any disclaimer, the term of this patent is extended or adjusted under 35 U.S.C. 154(b) by 0 days.

(21) Appl. No.: 13/438,260

(22) Filed: Apr. 3, 2012

(65) Prior Publication Data

US 2012/0273156 A1 Nov. 1, 2012

(30) Foreign Application Priority Data

Apr. 27, 2011 (JP) ..... 2011-099318

(51) Int. Cl.
*B22D 11/06* (2006.01)

(52) U.S. Cl. ..... 164/480; 164/428; 164/451

(58) Field of Classification Search ..... 164/428, 164/429, 451, 479, 480
See application file for complete search history.

(56) References Cited

U.S. PATENT DOCUMENTS

| | | | | |
|---|---|---|---|---|
| 4,651,802 | A | | 3/1987 | Wrhen |
| 4,723,590 | A | | 2/1988 | Yamauchi et al. |
| 4,811,780 | A | | 3/1989 | Yamauchi et al. |
| 4,869,310 | A | | 9/1989 | Yanagi et al. |
| 5,010,948 | A | | 4/1991 | Blin et al. |
| 5,035,278 | A | * | 7/1991 | Hasegawa et al. ..... 164/428 |
| 5,058,657 | A | | 10/1991 | Hasegawa et al. |
| 5,060,714 | A | | 10/1991 | Yamauchi et al. |
| 5,178,205 | A | | 1/1993 | Fukase et al. |
| 5,184,668 | A | | 2/1993 | Fukase et al. |
| 5,188,166 | A | | 2/1993 | Perry |
| 5,201,362 | A | | 4/1993 | Yamagami et al. |
| 5,207,265 | A | | 5/1993 | Hasegawa et al. |
| 5,273,103 | A | | 12/1993 | Tolve et al. |
| 5,277,243 | A | | 1/1994 | Fukase et al. |
| 5,318,097 | A | | 6/1994 | Blin et al. |
| 5,380,264 | A | | 1/1995 | Ookouchi et al. |
| 5,584,335 | A | | 12/1996 | Barbe et al. |
| 5,588,479 | A | | 12/1996 | Leadbeatter et al. |
| 5,628,359 | A | | 5/1997 | Legrand |

(Continued)

FOREIGN PATENT DOCUMENTS

| | | |
|---|---|---|
| AU | 693256 | 7/1996 |
| AU | 703994 | 7/1997 |

(Continued)

OTHER PUBLICATIONS

International Search Report for PCT/AU2007/000288, dated May 7, 2007.

(Continued)

*Primary Examiner* — Kevin P Kerns
*Assistant Examiner* — Kevin E Yoon
(74) *Attorney, Agent, or Firm* — Hahn, Loeser & Parks LLP; Arland T. Stein

(57) ABSTRACT

Described herein is a twin roll caster including a pair of casting rolls arranged parallel to one another with a gap between the casting rolls and side dams parallel to one another forming a pool between the casting rolls and side dams. A side dam support is provided that applies a compression force on at least one of the side dams at a compression angle relative to the axis of the casting rolls.

10 Claims, 7 Drawing Sheets

U.S. PATENT DOCUMENTS

| | | | |
|---|---|---|---|
| 5,638,892 | A | 6/1997 | Barbe et al. |
| 5,787,968 | A | 8/1998 | Lauener |
| 5,810,070 | A | 9/1998 | Osada et al. |
| 5,845,699 | A | 12/1998 | Baharis |
| 5,871,039 | A | 2/1999 | Osada et al. |
| 5,915,454 | A | 6/1999 | Wright et al. |
| 5,927,375 | A | 7/1999 | Damasse et al. |
| 5,964,276 | A | 10/1999 | Dompas et al. |
| 5,983,980 | A | 11/1999 | Freeman et al. |
| 5,996,680 | A | 12/1999 | Fukase et al. |
| 6,032,722 | A | 3/2000 | Russell et al. |
| 6,073,680 | A | 6/2000 | Folder |
| 6,079,480 | A | 6/2000 | Oka et al. |
| 6,082,437 | A | 7/2000 | Damasse et al. |
| 6,125,917 | A | 10/2000 | Cassar et al. |
| 6,145,581 | A | 11/2000 | Takeuchi et al. |
| 6,167,942 | B1 | 1/2001 | Fish et al. |
| 6,202,792 | B1 | 3/2001 | Cheong et al. |
| 6,237,673 | B1 | 5/2001 | Kato et al. |
| RE37,214 | E | 6/2001 | Barbé et al. |
| 6,296,046 | B1 | 10/2001 | Jeong et al. |
| 6,354,365 | B2 | 3/2002 | Capotosti et al. |
| 6,363,999 | B1 | 4/2002 | Smith |
| 6,378,598 | B1 | 4/2002 | Tonelli |
| 6,488,075 | B1 | 12/2002 | Breviere et al. |
| 6,497,270 | B1 | 12/2002 | Breviere et al. |
| 7,066,238 | B2 | 6/2006 | Hohenbichler et al. |
| 7,098,159 | B2 | 8/2006 | Krolikowski |
| 7,208,433 | B2 | 4/2007 | Nose et al. |
| 7,258,157 | B2 | 8/2007 | Damasse et al. |
| 7,308,930 | B2 | 12/2007 | Huffman et al. |
| 7,503,375 | B2 | 3/2009 | Schueren |
| 7,556,084 | B2 | 7/2009 | Bowman et al. |
| 7,975,755 | B2 | 7/2011 | Schueren |
| 8,051,895 | B2 | 11/2011 | Otsuka et al. |
| 2002/0079390 | A1 | 6/2002 | Jungling et al. |
| 2006/0054298 | A1 | 3/2006 | Hohenbichler et al. |
| 2006/0081352 | A1 | 4/2006 | Damasse et al. |
| 2006/0102312 | A1 | 5/2006 | Poloni et al. |
| 2006/0166808 | A1 | 7/2006 | Nose et al. |
| 2007/0209777 | A1 | 9/2007 | Huffman et al. |
| 2010/0101752 | A1 | 4/2010 | Otsuka et al. |

FOREIGN PATENT DOCUMENTS

| | | |
|---|---|---|
| AU | 739603 | 4/1999 |
| AU | 743036 | 12/1999 |
| EP | 0107970 | 5/1984 |
| EP | 0182468 | 5/1986 |
| EP | 0546206 | 6/1993 |
| EP | 0714715 | 6/1996 |
| EP | 0782894 | 7/1997 |
| EP | 0947261 | 10/1999 |
| EP | 1957220 | 8/2008 |
| GB | 2296883 | 7/1996 |
| JP | 59-215254 | 12/1984 |
| JP | 60-162558 | 8/1985 |
| JP | 61-037354 | 2/1986 |
| JP | 61-042454 | 2/1986 |
| JP | 61-144245 | 7/1986 |
| JP | 62-064456 | 3/1987 |
| JP | 63-036954 | 2/1988 |
| JP | 63-177944 | 7/1988 |
| JP | 02-070359 | 3/1990 |
| JP | 02-099244 | 4/1990 |
| JP | 03-230848 | 10/1991 |
| JP | 05-269551 | 10/1993 |
| JP | 06-015414 | 1/1994 |
| JP | 06-134553 | 5/1994 |
| JP | 08-013403 B | 2/1996 |
| JP | 2000-000641 | 1/2000 |
| JP | 2003-305547 | 10/2003 |
| JP | 2004-122193 | 4/2004 |
| JP | 2011-099318 | 5/2011 |
| KR | 10-0605703 | 8/2006 |
| WO | 9932247 | 7/1999 |
| WO | 2005002757 | 1/2005 |
| WO | 2005023458 | 3/2005 |
| WO | 2005025773 | 3/2005 |
| WO | 2008106744 | 9/2008 |
| WO | 2009041777 | 4/2009 |

OTHER PUBLICATIONS

International Search Report for PCT/AU2009/000806, dated Aug. 31, 2009.
International Search Report for PCT1AU2012/000444, dated Jun. 4, 2012.
International—Type Search Report for AU2006902146, dated May 17, 2006.
English translation of JP02-070359 abstract.
English translation of JP02-099244 abstract.
English translation of JP03-230848 abstract, dated May 10, 2006.
English translation of JP05-269551.
English translation of JP08-013403, dated May 5, 2006.
English translation of JP59-215254 abstract, dated May 10, 2006.
English translation of JP61-037354 abstract, dated Sep. 15, 2009.
English translation of JP61-042454 abstract, dated May 8, 2006.
English translation of JP61-144245 abstract.
English translation of JP62-064456 abstract.
English translation of JP63-036954 abstract, dated May 22, 2006.
English translation of JP63-177944 abstract.
English translation of JP2000-000641 abstract.
English translation of JP2004-122193 abstract.
English translation of KR10-0605703 abstract, dated May 22, 2006.
English translation of WO2005002757 abstract, dated May 22, 2006.
English translation of WO2005023458 abstract, dated May 22, 2006.
English translation of WO2005025773 abstract, dated May 22, 2006.
Written Opinion for PCT/AU2007/000288, dated May 7, 2007.
Written Opinion for PCT/AU2009/000806, dated Aug. 31, 2009.
Written Opinion for PCT/AU2012/000444, dated Jun. 4, 2012.

* cited by examiner

TWIN ROLL CASTER AND METHOD OF CONTROL THEREOF

CROSS-REFERENCE TO RELATED APPLICATIONS

This application claims priority to Japanese Patent Application No. 2011-099318 filed Apr. 27, 2011.

BACKGROUND AND SUMMARY OF THE INVENTION

This invention relates to the casting of metal strip by continuous casting in a twin roll caster.

In a twin roll caster, molten metal is introduced between a pair of counter-rotated casting rolls that are cooled so that metal shells solidify on the moving roll surfaces and are brought together at a nip between them. The term "nip" is used herein to refer to the general region at which the rolls are closest together. The molten metal may be poured from a ladle into a smaller vessel or series of smaller vessels from which it flows through a metal delivery nozzle located above the nip forming a casting pool of molten metal supported on the casting surfaces of the rolls immediately above the nip and extending along the length of the nip. The molten metal forms shells on the casting surfaces that join and pass through the nip between the casting rolls as thin metal strip is cast downwardly from the nip.

The casting pool is usually confined between side plates or dams held in sliding engagement with end surfaces of the casting rolls so as to constrain the two ends of the casting pool against outflow. Side dams at the ends of the casting rolls prevent leakage of molten metal from the casting pool and maintain the casting pool at a desired depth. As the casting rolls are rotated, the side dams experience frictional wear, causing arc-shaped grooves to form in the side dams along the circumferential surfaces of the casting rolls. In order to compensate for this wear, the side dams are movable to gradually shift inward under compression forces in order to maintain the seal with the casting rolls.

The useful life of the side dam has traditionally been limited by the depth of the arc-shaped grooves that can be made without risk of solidified sculls forming and dropping through the nip between the casting rolls and forming defects, called "snake eggs," in the cast strip. It has been proposed to increase the life of the side dams by making them vertically moveable so they can be moved upward. That way multiple arc-shaped grooves can be worn into the same side dam, thereby increasing the useful life of the side dam. Examples of these past proposals for increasing the useful life of side dams are described in U.S. Pat. No. 7,066,238 and U.S. Patent Publications Nos. 2006/0054298 and 2010/0101752. However, there continues to be a need for a way to improve the operational life of side dams.

In any event, the arc-shaped grooves tend to promote the formation of solidified sculls in the molten metal that tend to cause the formation of snake-egg defects in the cast strip. Where the side dams engage with the ends of the casting rolls, the amount of cooling of the metal shells on the casting rolls is higher than in the center of the rolls. The solidified sculls can form in solidified shells adjacent the side dams in the arc-shaped grooves and may give rise to 'snake egg' defects in the formed metal strip.' Such snake eggs can cause not only defects in the cast strip but may also cause the continuous metal strip to break or otherwise rupture as the strip is formed. Accordingly, there remains a need for a twin roll caster and method of operating the same, that reduces the likelihood of formation of snake eggs by inhibiting the formation of arc-shaped grooves in the side dams adjacent the casting rolls, while extending the operating life of the side dams.

Disclosed herein is a twin roll caster comprising:

a pair of counter-rotatable casting rolls having casting surfaces laterally positioned to form a nip there between through which thin cast strip can be cast, and supporting a casting pool of molten metal on the casting surfaces above the nip;

a pair of side dams positioned to engage end portions of the casting rolls adjacent the nip to laterally confine said casting pool; and a side dam support applying a compression force against at least one of said side dams at an upward angle between 15° and 45° relative to an axis of said casting rolls.

A side dam support may be provided at each end portion of the casting rolls applying an angular compression force against each side dams at an upward angle between 15° and 45° relative to an axis of said casting rolls. In any case, during operation said side dam is worn by said end surfaces of said casting rolls to form a slantwise groove in each side dam. The slantwise groove may be in the form of V-shaped arcuate grooves.

The side dam supports may comprise a lateral pushing apparatus to push said side dam against said end surfaces and a vertical pushing apparatus to adjust the height of said lateral pushing apparatus, and the lateral pushing apparatus and the vertical pushing apparatus may be adapted to operate at the same time.

In addition, a control device may be adapted to control said vertical pushing device and said lateral pushing device to provide a target compression angle. Alternatively, the side dam support comprises a slantwise pushing apparatus adapted to push said side dam against said end surfaces of the casting roll at a target compression angle. The compression angle may be dynamically controlled.

Also disclosed is a method of controlling a twin roll caster having two laterally positioned casting rolls forming a nip there between and two side dams positioned adjacent opposite end portions of the casting rolls to enable a casting pool to be formed on the casting rolls above the nip, the method comprising the steps of:

providing a compression device to apply a compression force against said side dams inwardly towards end portions of said casting rolls at an upward angle, and forming slantwise grooves worn in the side dams by said end portions of said casting rolls.

The method of controlling a twin roll caster may include causing the compression device to apply the compression force to form slantwise grooves in a series of V-shaped grooves by the steps of determining a target step thickness and spread angle for V-shaped grooves, and control the compression device to provide the compression angle to provide said target step thickness and spread angle in the side dams. The method may include providing a lateral force parallel to an axis of said casting rolls and a vertical force perpendicular to said lateral force to form a resultant compression force at said compression angle.

The method may include providing a control device to determine said compression angle and communicate with said compression device to adjust said compression angle. The compression device may be a slantwise compression device to provide said compression force at said compression angle. Said slantwise compression device may also include an angular adjustment member for adjusting said compression angle.

Also, said slantwise compression device may include a displacement measuring device. The further steps of communicating a displacement value from said displacement measuring device to a control device, determining a target compression angle based on said displacement value and a target spread angle, and communicating a value to said angular adjustment member to adjust said slantwise compression device to said target compression angle. Said spread angle may be either variable or fixed

BRIEF DESCRIPTION OF DRAWINGS

FIG. 5B is a section view of the side dam and casting rolls taken along line B-B in

FIG. 5A.

DETAILED DESCRIPTION OF DRAWINGS

Figure 1:
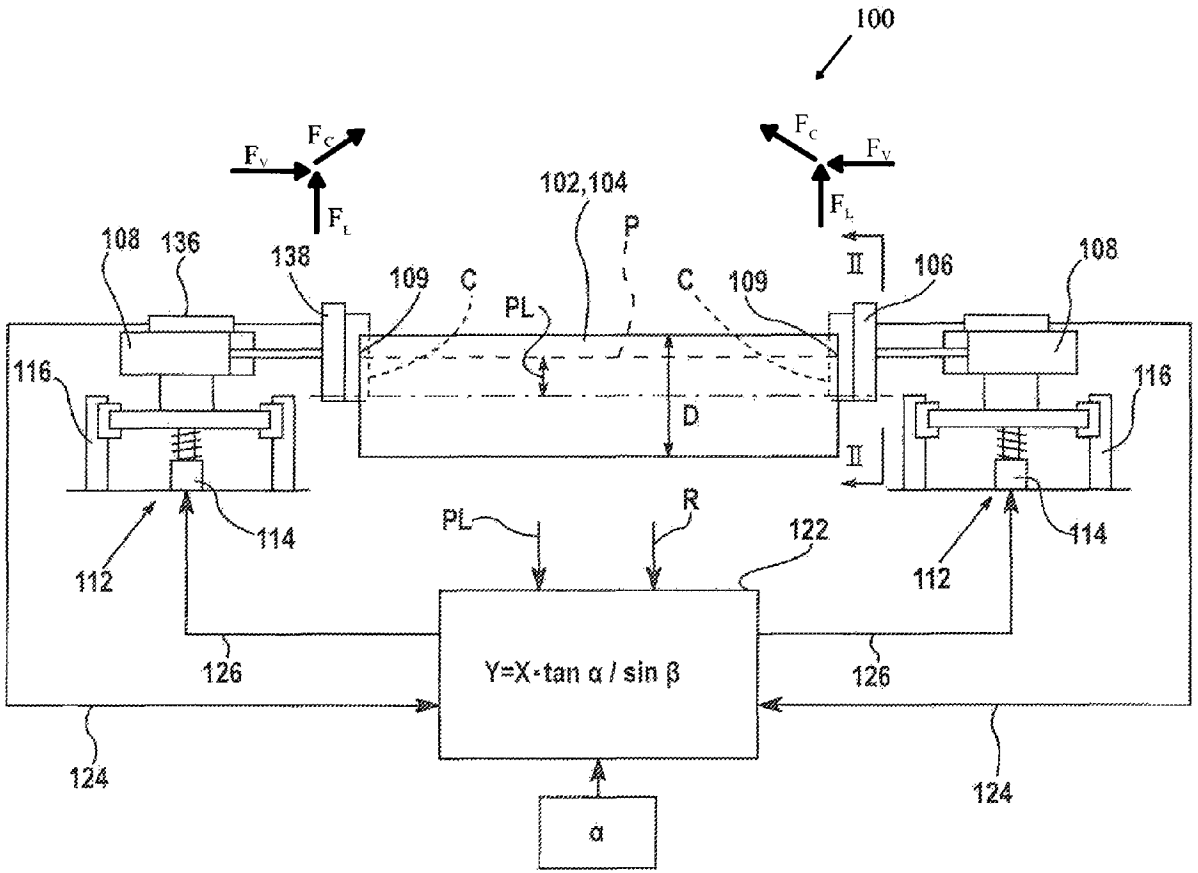
FIG. 1 is a side view of a twin roll caster system according to one embodiment of the invention.

A twin roll caster system 100 is generally shown in FIG. 1. According to the embodiment illustrated, the twin roll caster system 100 includes first casting roll 102 and second casting roll 104 positioned laterally to one another forming a nip or gap G between them. At opposite ends of the casting rolls 102, 104 are positioned side dams 106, thereby defining a pool P for receiving and forming casting pool P on the casting rolls 102,104 above the nip. One or more delivery nozzles (not shown) are positioned above the casting rolls 102, 104 between side dams 106 to deliver molten metal into the casting pool P in a continuous supply during casting. The side dams 106 are urged against the casting rolls 102, 104 by inward biasing forces to provide a tight seal in order to prevent molten metal from leaking from the casting pool P. Compression devices 108 are provided to engage the side dams 106 and provide the inward biasing force against the casting rolls 102, 104.

During a casting campaign, the first casting roll 102 and the second casting roll 104 are rotated in opposing directions towards the gap G to cast metal strip 111 having a predetermined thickness corresponding generally to width of gap G downwardly from the gap G. The casting rolls 102, 104 are internally cooled so that as they rotate through the casting pool P of molten metal and thin shells of solidified metal are formed on the rolls 102, 104. The side dams 106, as a consequence of being biased against the rotating casting rolls 102, 104, will experience gradual wear, resulting in arcuate shaped cut-aways formed by abrasion in the side dams.

Figure 3:
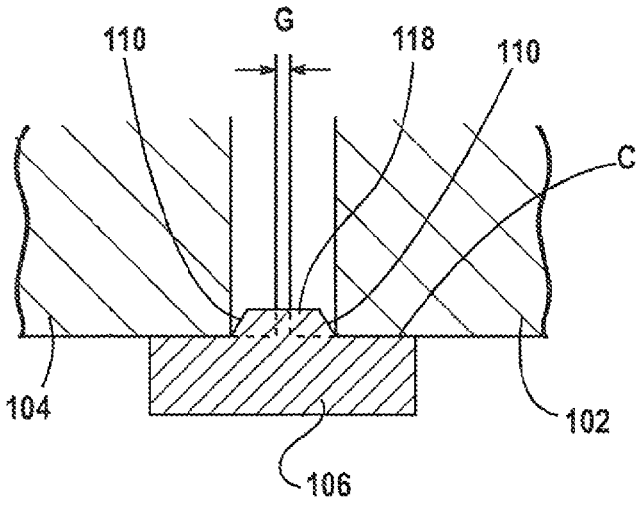
FIG. 3 is an enlarged section view of side dams taken along line 3-3 in FIG. 2.
Figure 4:
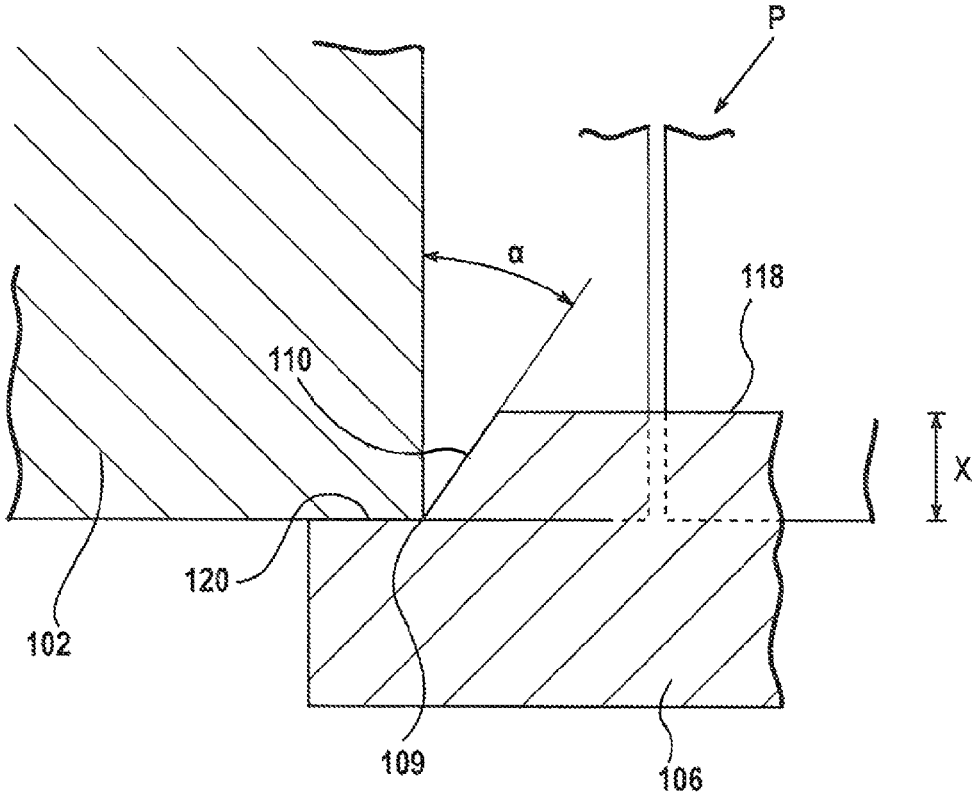
FIG. 4 is an enlarged section view of the side dams taken along line 4-4 in FIG. 2.

According to one embodiment, the compression devices 108 each apply a lateral force $F_L$ (inwardly in the direction of the axes of the casting rolls 102, 104) and an upward vertical force $F_V$ (perpendicular to the lateral $F_L$) on the side dams 106 applied by vertical drives 112 against compression devices 108. Upward vertical force $F_V$ is accordingly a net force equal to the vertical force generated by each vertical drive 112 less the force attributable to lifting the compression drives 108. The combined resultant force $F_C$ causes each of the side dams 106 to move inward and upward as the side dams 106 are abraded by casting rolls 102, 104 to form arcuate cut-aways 109. As a result, arcuate shaped cut-aways 109 are formed typically with V-shaped grooves 110 as shown in FIGS. 3 and 4, which extend and spread away from the side dams 106. These slantwise grooves 110 allow for an increased flow of molten metal over the arcuate gaps C inhibiting the formation of the sculls and enabling consistent and effective casting of metal strip during the casting campaign.

As shown in FIG. 1, the compression devices 108 each may have a hydraulic cylinder that engages one of the side dams 106 and applies a lateral force $F_L$, urging the dam 106 inwardly toward the ends of the casting rolls 102, 104. Vertical drives 112 each provide a vertical force which nets as an upwardly vertical force $F_V$ on the side dam 106 through the compression device 108. As shown in FIG. 1, each of these vertical drives 112 may include a screw jack 114 which adjusts the height of a compression device 108. The screw jack 114 may advance the compression device 108 upwardly along guide members 116, such as slide rails or similar guides as shown in FIG. 1.

Those having skill in the art will appreciate that the lateral $F_L$ and vertical $F_V$ forces may be applied independent of one another. However, as shown, the lateral $F_L$ and vertical $F_V$ forces combined to apply a resultant compression force $F_C$ at an upward angle $\gamma$ against the casting rolls 102, 104. The magnitude and angle of the resultant compression force $F_C$ is variable and changed based on the magnitudes of the lateral $F_L$ and vertical $F_V$ forces. Because the lateral $F_L$ and vertical $F_V$ forces may be independently controlled (lateral force by the compression device 108 and vertical force by the vertical drive 112), the angle and magnitude of the compression force $F_C$ may be dynamically variable.

Figure 2:
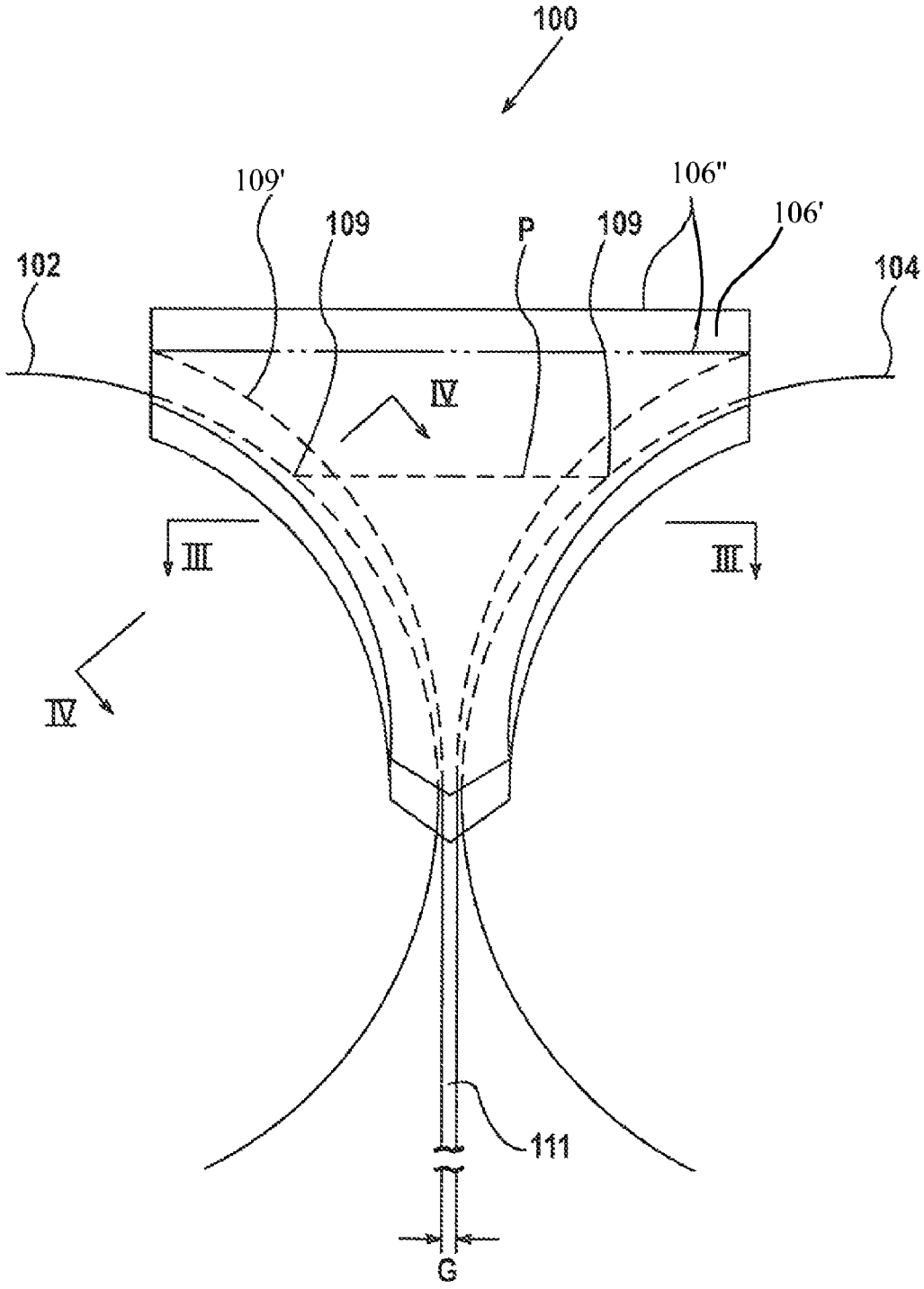
FIG. 2 is an end section view of the twin roll caster system of FIG. 1 taken along line 2-2 in FIG. 1.

FIG. 2 shows a side view illustrating the location of the side dams 106 relative to the casting rolls 102, 104. The double dashed lines in this side view show a first position 106' of upper portions of the side dam 106 and the solid lines show a second position 106" of upper portions of the side dam 106 after it has been advanced by one of the vertical drivers 112. The dashed lines illustrate the location of the side dams 106 when the casting rolls 102, 104 engage and begin to abrade the side dams 106. As will be appreciated, as the side dams 106 are abraded by the end surfaces of the casting rolls 102, 104, the side dams 106 are shifted upwardly, thereby moving the arc-shaped cut-way 109 away from the casting rolls 102, 104 as shown by arc-shaped cut-away 109 shown in FIG. 2.

Figure 5A:
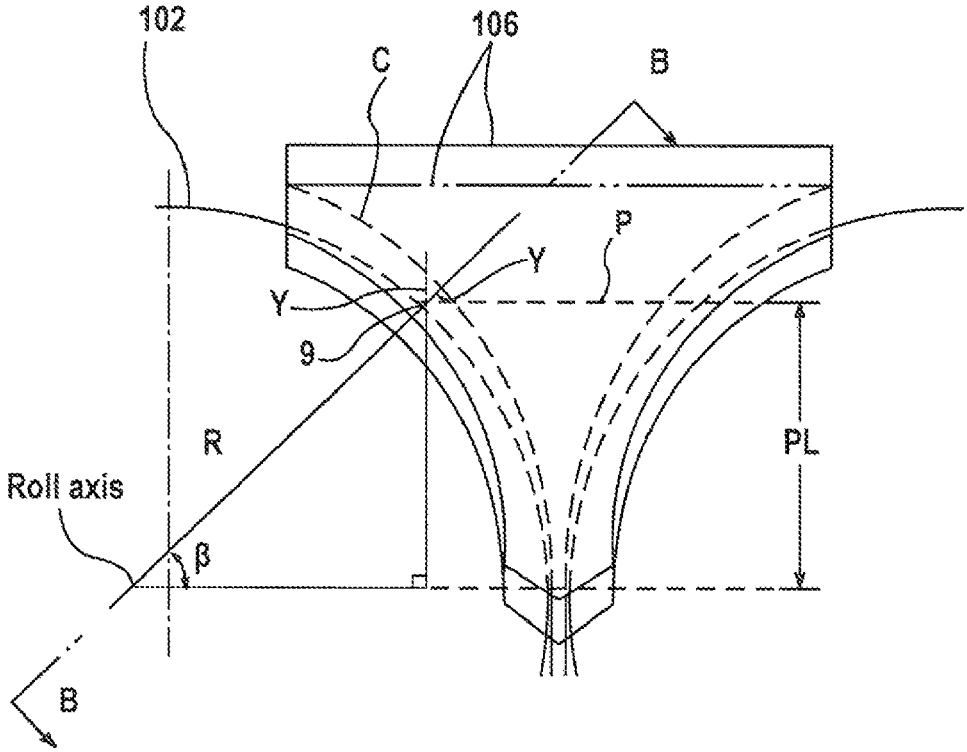
FIG. 5A is an alternative view of the section taken along line 2-2 in FIG. 1.

FIG. 3 illustrates a side view of one of the side dams 106 taken along line 3-3 in FIG. 2 and FIG. 4 is a side view taken along line 4-4 in FIG. 2. According to the embodiment illustrated in this figure, each of the side dams 106 includes an unworn portion 118 that extends into the space between the casting rolls 102, 104 as the side dam 106 is abraded, forming arc-shaped grooves 110. Because the side dams 106 are independently adjusted in a vertical and horizontal direction, these grooves 110 will be V-shaped, as the unworn portion 118 of the side dam 106 is moved inward and upward away from the casting rolls 102, 104. As shown in FIG. 4, the V-shaped grooves 110 will extend at a spread angle $\alpha$ away from the casting roll 102. Therefore, the side dam 106 will include an abraded portion 120, an unworn portion 118, and a slantwise portion extending at $90°+\alpha$ from the abraded 120 to unworn portion 118. The spread angle $\alpha$ and thickness X of this slantwise portion may be determined by the lateral $F_L$ and vertical $F_V$ forces as described herein with reference to FIGS. 1 and 4-5. Alternatively, the spread angle α and thickness X may be set and the lateral $F_L$ and vertical $F_V$ forces may be adjusted to produce the desired spread angle α and thickness X.

According to alternative embodiments, the spread angle Δ and thickness X of the arc-shaped grooves 110 may vary during the casting campaign, causing the grooves 110 to have a non-linear V-shape or stepped shape, or include one or more different spread angles α and thicknesses X during different segments of the casting campaign, and may be concave, convex, even, and uneven V-shaped steps, or some combination thereof.

In FIG. 1, a control device 122 is provided that calculates the amount of lift Y that is to be provided by each of the vertical drives 112 for a given thickness X and spread angle α of the slantwise groove and is given by the formula:

$$Y=X*\tan(\alpha)/\sin(\beta)$$

As discussed above, the thickness X and spread angle α are provided based on the desired shape of the slantwise grooves 110 and may vary over time. The angle β is based on the height of the casting pool P along a vertical measurement PL from the center of the casting roll 102 (shown in FIG. 5A) and the radius R (also D/2) of one of the casting rolls 102. The angle β is given by the formula:

$$\sin(\beta)=PL/R$$

Therefore, to calculate the amount of lift Y provided by each of the vertical drives 112, the control device 122 must receive as input the desired spread angle α, the displacement X of the compression devices 108, the pool height PL and the radius R of the respective of the casting rolls 102. These values are used to calculate the desired lift Y that will result in the desired spread angle α. The desired displacement X of the compression devices 108 is provided by means of an input signal 124 from the compression devices 108 to the control device 122. The control device 122 then processes this information and sends a command signal 126 to the vertical drives 112 to provide the appropriate amount of lift Y to be applied by the vertical drives 112. In the embodiment illustrated in FIG. 1, each of the vertical drives 112 may have a screw jack 114 and, therefore, the control signal 126 may be an electrical pulse, timed output, change in frequency, or other type of electrical communication to raise one of the side dams 106. The amount of lift of these side dams 106 is controlled so that the side dam provides the desired spread angle α to encourage consistent temperature control of the molten metal in the slantwise groove 110 while avoiding leakage of molten metal from the pool casting P spread.

Figure 5B:
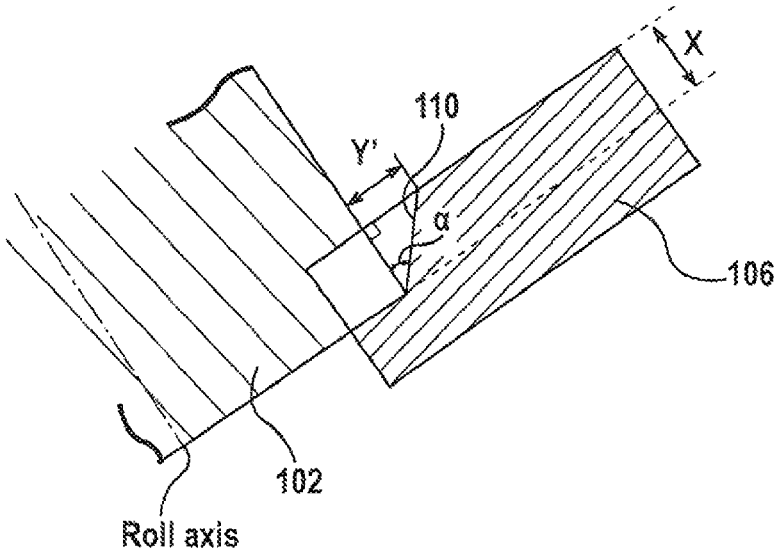

FIG. 5B shows the arc-shaped slantwise groove 110 in further detail where the relationship between X, Y', and α is illustrated relative to the casting rolls 102, 104, and side dams 106. This view is taken along line B-B in FIG. 5A. As shown, the value Y' is the radial displacement of the slantwise groove 110 and is perpendicular to the lateral displacement X of the side dam 106.

An examination of the amount of lifting movement Y for a spread angle α from 10-70° was determined and is provided in the following Table 1. In this arrangement, the diameter of the casting rolls 102, 104 was each 500 mm (radius R=250 mm), side dams 106 abrasion (X) was 10 mm, and the highest level of lift, while preventing leakage, was 15 mm (related to height PL). As will be appreciated from the following table, at certain spread angles (greater than approximately 45°), the amount of lifting movement Y is too high to prevent leakage of molten metal from the pool P. Therefore, these spread angles α would be unsuitable given the provided limitations.

TABLE 1

| Spread angle α (°) | Amount of lifting movement (mm) |
|---|---|
| 10 | 2.5 |
| 20 | 5.2 |
| 30 | 8.3 |
| 45 | 14.4 |
| 60 | 24.9 |
| 70 | 53.7 |

As shown, when the spread angle α was within the range of 20-45°, the amount of metal invading and heating the slantwise grooves was found to be high. Further, when the spread angle and lifting movement were around the maximum allowable lift, molten metal flow and heating into the grooves 110 was as desired. In this example then a target spread angle α of 45° is desired.

Figure 6:
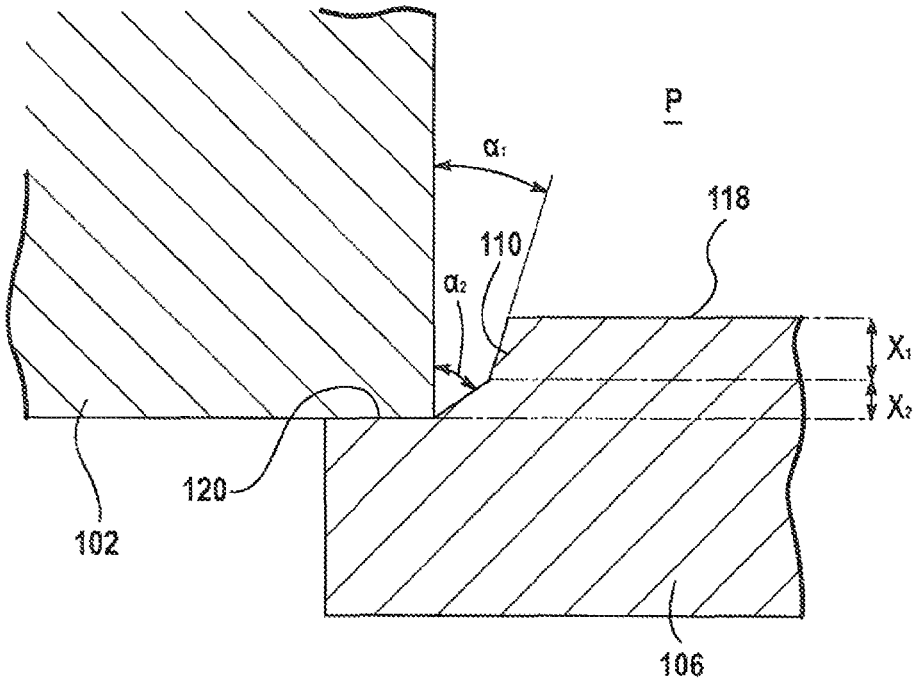
FIG. 6 is an alternative arrangement of the section view of FIG. 5B taken along line B-B of FIG. 5A.

An alternative embodiment of the invention is illustrated in FIG. 6. In this embodiment, the slantwise groove 110 may be comprised of first $\alpha_1$ and second $\alpha_2$ spread angles. According to this embodiment, during a first part of the casting campaign first spread angle $\alpha_1$ is the target angle provided to the control device 122. This angle is maintained for a first compression distance $X_1$. A second angle $\alpha_2$ is then provided during a second segment of the casting campaign for a second compression distance $X_2$. According to the embodiment illustrated in FIG. 6, the second spread angle $\alpha_2$ is smaller than the first spread angle $\alpha_1$, thereby forming a concave slantwise groove 110. Alternatively, the second spread angle $\alpha_2$ may be larger than the first spread angle $\alpha_1$ creating a convex arc-shaped slantwise groove 110. Further, while the embodiment illustrated shows first $\alpha_1$ and second $\alpha_2$ spread angles, the apparatus may be designed to include any number of angles, regular or irregular steps, or may be a smooth curve, such as a part of a part of a circle, parabola, or the like.

Figure 7:
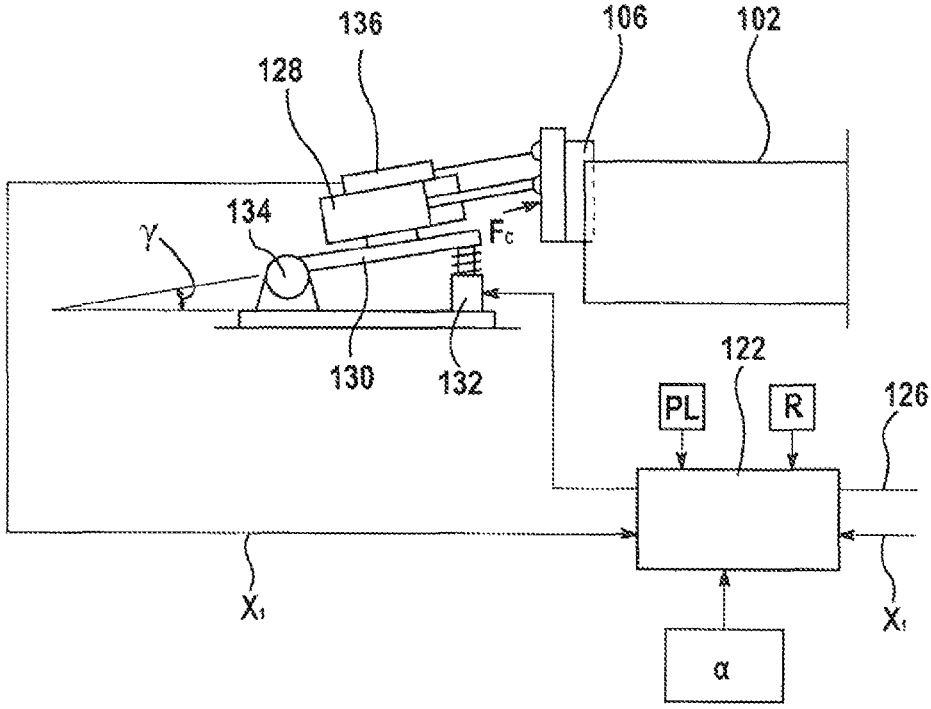
FIG. 7 is a side view of the twin roll caster system of FIG. 1 according to an alternative arrangement.

FIG. 7 illustrates another embodiment of the twin roll caster system 100. In this embodiment, rather than a compression device 108 providing a lateral force $F_L$ and a vertical drive 112 netting a vertical force $F_V$, an angled compression device 128 is provided to directly generate compression force $F_C$. This angled compression device 128 may produce an application force $F_C$ at a predetermined application angle γ. According to the aspect illustrated in FIG. 7, the angled compression device 128 is provided on an adjustable table 130 and an angular displacement adjustment mechanism 132, such as a screw drive or other fine adjustment mechanism, may also be provided on one end of the adjustable table 130. The other end of the adjustable table 130 may be secured by a pivot 134 so that the application angle γ is adjustable by means of the angular displacement adjustment mechanism 132.

As with the embodiment illustrated in FIG. 1, a control device 122 may also be provided for determining the appropriate application angle γ to given a desired spread angle α for the V-shaped groove 110 (see FIG. 4). The control device 122 may receive as inputs the amount of displacement X' of the angled compression device 128, preferred spread angle α, pool height PL, and roll radius R and output to the angular displacement adjustment mechanism 132 a command signal 126 indicating the amount of displacement necessary to provide the appropriate application angle γ.

Figure 8:
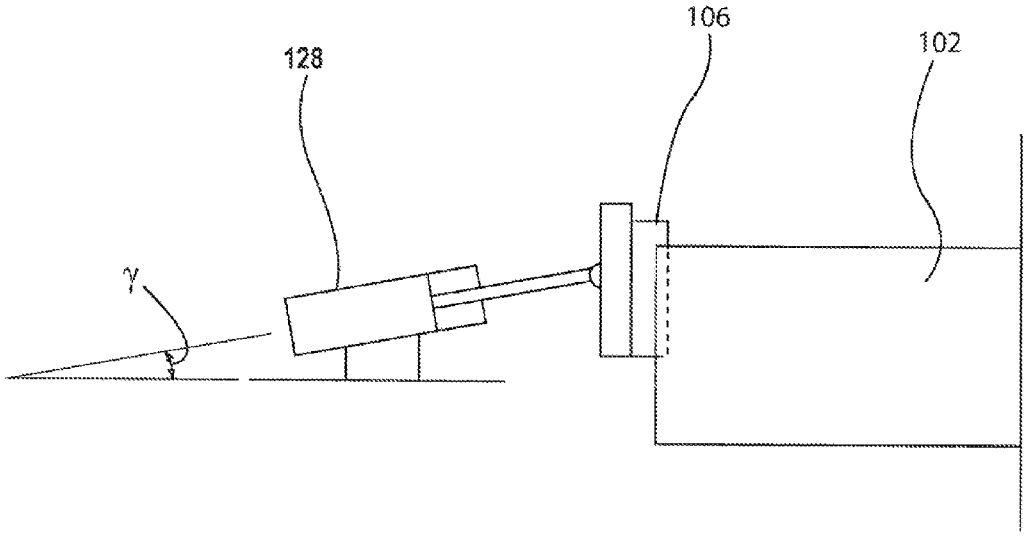
FIG. 8 is a side view of the twin roll caster system of FIG. 1 according to an alternative arrangement.

Yet another embodiment of the twin roll caster system 100 is illustrated in FIG. 8. Unlike the embodiment illustrated in FIG. 7, the embodiment of FIG. 8 is fixed at a desired application angle γ and is not adjustable. Further, no control device 122 (FIG. 7) is provided for measuring, monitoring, or adjusting the compression angle γ during a casting campaign.

According to the various embodiments described above, the compression devices 108 or angled compression devices 128 may be pneumatic, hydraulic, screw-driven, or other types of pistons having an arm and a body. The amount of displacement of the compression devices 108 or angled compression devices 128 may be given by the amount of displacement of the arm. Alternatively, a separate displacement measuring device 136 may be provided for measuring the displacement X of the side dam 106 during the casting operation. Further, according to one embodiment the pistons of the compression devices 108 or angled compression devices 128 may be each secured to the side dam 106 by means of a jig 138 or similar apparatus. Alternatively, these compression devices 108 or angled compression devices 128 may be directly connected to the side dam 106.

Figure 9A:
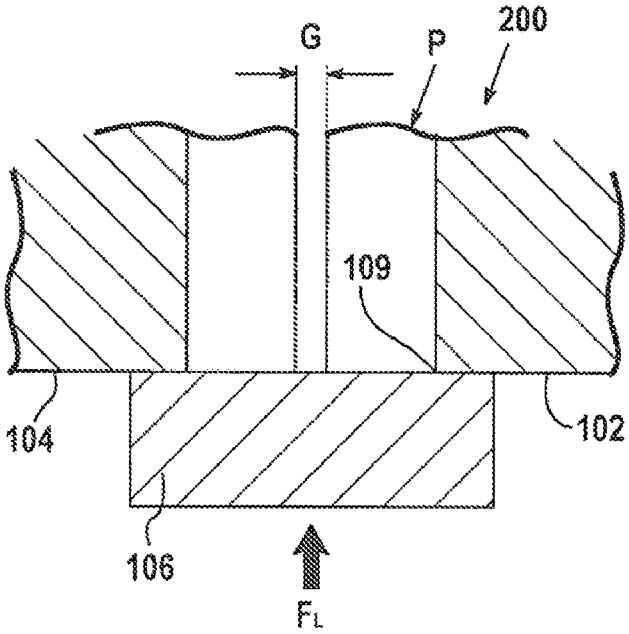
FIG. 9A is a top view of a prior art twin roll caster system.
Figure 9B:
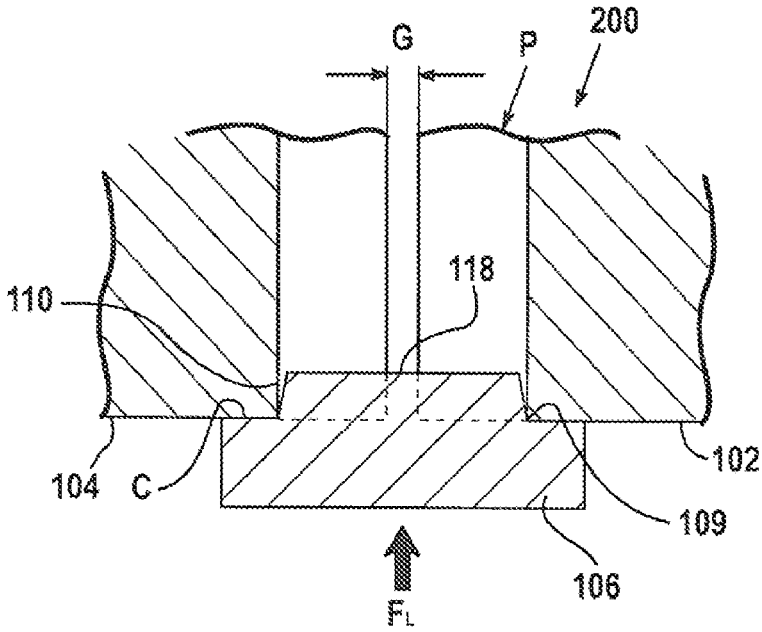
FIG. 9B is a top view of the prior art twin roll caster system of FIG. 9A showing the wear pattern of the side dam.

FIGS. 9A and 9B show a top view of prior art twin roll caster system 200 which apply a lateral force $F_L$ to the side dams 106 without a lifting or vertical force $F_V$, providing a small gap 110 which has no appreciable spread angle α.

This written description uses examples to disclose the invention, including the best mode, and also to enable one of ordinary skill in the art to practice the invention, including making and using any devices or systems and performing any incorporated methods. The patentable scope of the invention is determined by the claims, and may include other examples that occur to one of ordinary skill in the art. Such other examples are intended to be within the scope of the claims, if they have structural elements that do not differ from the literal language of the claims, or, if they include equivalent structural elements with insubstantial differences from the literal language of the claims.

What is claimed is:

1. A method of controlling a twin roll caster having two laterally positioned casting rolls forming a nip there between and two side dams positioned adjacent opposite end portions of the casting rolls to enable a casting pool to be formed on the casting rolls above the nip, the method comprising the steps of:

providing a compression device and applying a compression force against said side dams towards the end portions of said casting rolls at an upward angle; and forming slantwise grooves worn in the side dams by said end portions of said casting rolls.

2. A method of controlling a twin roll caster as claimed in claim 1 where:

the compression device applies the compression force to form the slantwise grooves in the form of V-shaped grooves by the steps of:

determining a target step thickness and spread angle of said V-shaped grooves; and controlling the compression device to provide said target step thickness and spread angle in the side dams.

3. The method as set forth in claim 2 wherein said compression device provides a lateral force parallel to an axis of said casting rolls and a vertical force perpendicular to said lateral force that a resultant force is equal to said compression force to provide said compression angle.

4. The method as set forth in claim 3 further comprising the steps of providing a control device to determine said compression angle and communicate with said compression device to adjust said compression angle.

5. The method as set forth in claim 2 where said compression device includes a slantwise compression device to provide said compression force at said compression angle.

6. The method as set forth in claim 5 where said slantwise compression device includes an angular adjustment member for adjusting said compression angle.

7. The method as set forth in claim 6 where said slantwise compression device includes a displacement measuring device.

8. The method as set forth in claim 7 comprising the further steps of communicating a displacement value from said displacement measuring device to a control device; determining a target compression angle based on said displacement value and a target spread angle; and communicating the value to said angular adjustment member to adjust said slantwise compression device to said target compression angle.

9. The method as set forth in claim 8 where said spread angle is variable.

10. The method as set forth in claim 8 where said spread angle is fixed.

* * * * *